US005695308A

United States Patent [19]

Hastings et al.

[11] Patent Number: 5,695,308

[45] Date of Patent: Dec. 9, 1997

[54] SPIRAL BINDING METHOD AND APPARATUS

[75] Inventors: Mark E. Hastings; Randy C. Peterson; Kevin L. Engelbert, all of Mukilteo; John H. Mar, Seattle, all of Wash.

[73] Assignee: Unicoil, Inc., Norcross, Ga.

[21] Appl. No.: 539,848

[22] Filed: Oct. 6, 1995

Related U.S. Application Data

[63] Continuation-in-part of Ser. No. 320,283, Oct. 11, 1994, Pat. No. 5,584,632.

[51] Int. Cl.[6] ..... B42B 5/10

[52] U.S. Cl. ..... 412/39

[58] Field of Search ..... 412/9, 33, 38, 412/39, 40, 42, 43; 140/92.3, 92.4, 92.9, 92.93, 92.94

[56] References Cited

U.S. PATENT DOCUMENTS

| | | |
|---|---|---|
| 3,122,761 | 3/1964 | Bouvier . |
| 3,367,649 | 2/1968 | Thomas et al. . |
| 3,459,242 | 8/1969 | Schmidt . |
| 3,467,150 | 9/1969 | Ostermeier . |
| 3,486,537 | 12/1969 | Sickinger . |
| 3,592,242 | 7/1971 | Sickinger . |
| 3,793,660 | 2/1974 | Sims et al. . |
| 3,818,954 | 6/1974 | Pfaffle . |
| 3,826,290 | 7/1974 | Pfaffle . |
| 3,889,309 | 6/1975 | Adams et al. . |
| 3,924,664 | 12/1975 | Pfaffle . |
| 3,972,109 | 8/1976 | Sickinger . |
| 4,129,156 | 12/1978 | Pfaffle . |
| 4,129,913 | 12/1978 | Pfaffle . |
| 4,143,686 | 3/1979 | Sickinger et al. . |
| 4,185,668 | 1/1980 | Harbert . |
| 4,208,750 | 6/1980 | Pfaffle . |
| 4,249,278 | 2/1981 | Pfaffle . |
| 4,378,822 | 4/1983 | Morris . |

FOREIGN PATENT DOCUMENTS

| | | |
|---|---|---|
| 717238 | 9/1965 | Canada . |

*Primary Examiner*—Willmon Fridie, Jr.

*Attorney, Agent, or Firm*—Christensen O'Connor Johnson & Kindness PLLC

[57] ABSTRACT

An apparatus for spiral binding a stack of papers together as a unit. The apparatus includes a spiral binding unit for feeding a spiral coil into the holes in the stack of papers, a pin extension and retraction mechanism, a coil cutter mechanism, and a paper thickness measuring and sizing mechanism. The spiral binding unit includes an aperture through which a spiral coil is inserted between a feed shaft and a rotatably mounted roller. As the coil is inserted, the roller pushes the spiral coil into contact with the feed shaft. As the roller rotates, the coil is guided around a plurality of spiral guides that cause the coil to spiral into the holes in the stack of paper. The pin extension and retraction mechanism includes a plurality of locator pins that are movable between an extended and a retracted position. In the extended position, the pins extend up through the holes in the stack of papers. The locator pins are mounted on pivotally mourned levers. The levers are in turn rotated by a cam shaft. The paper thickness and sizing mechanism measures the thickness and width of the stack of papers. This information is used to provide the operator an indication of the proper coil size to use. This information is also used by the coil cutter to cut the coil to the proper length.

26 Claims, 12 Drawing Sheets

SPIRAL BINDING METHOD AND APPARATUS

This is a continuation in part of the prior application Ser. No. 08/320,283, filed on Oct. 11, 1994 now U.S. Pat. No. 5,584,632 the benefit of the filing date of which is hereby claimed under 35 U.S.C. §120.

FIELD OF THE INVENTION

The invention relates generally to methods and apparatus for binding sheets of paper or other materials together, more specifically, the invention relates to the spiral binding of sheets of paper or other flat stock materials.

BACKGROUND OF THE INVENTION

Many methods of binding sheets of paper or other flat stock materials together as a unit have been developed in the past, including book binding, Velobinding®, spiral binding, etc. Each method has its own advantages and disadvantages. Classic book binding, although preferred in many applications, requires equipment and manufacturing techniques that generally do not lend themselves to low volume binding, such as that required in small companies, offices, print shops, etc. Velobinding may be performed with equipment readily available to small offices or print shops. The bound unit produced by Velobinding requires a large margin on the left-hand side and does not allow the resulting unit to be easily laid open for viewing.

Spiral binding allows a stack of papers to be bound together as a unit that is easily opened to any page, thus making it very acceptable in the marketplace. However, in the past the equipment required to spiral bind a stack of papers has not lent itself to application in small businesses, offices, print shops, etc., due to the expense and complexity of the binding equipment.

In spiral binding, a series of equally-spaced holes are punched in one edge of the stack of papers. A continuous spiral coil is then fed or spiraled through the holes to form a bound unit. Spiral binding has been a preferred method of binding for many years and a number of manufacturers sell equipment to perform spiral binding.

Typically, a pre-wound spiral coil is placed around an appropriately sized mandrel or a coil is wound over the mandrel. The stack of papers to be bound together is first punched along one edge and then positioned near the end of the mandrel. A roller is moved into contact with the outer surface of the spiral coil, pressing the inner surface of the coil against the mandrel. The free end of the spiral coil extending out from one end of the mandrel is manually placed within the first hole in the stack of papers. The roller is then rotated, causing the coil to rotate. As the roller rotates, the coil spirals into the holes in the stack of papers, binding them together as a unit. Exemplary prior an equipment used to perform spiral binding is disclosed in U.S. Pat. No. 4,378,822, issued to Morris and U.S. Pat. No. 4,249,278 issued to Pfaffle.

Most prior spiral binding equipment is large, complex, and designed for use in assembly lines where commercially produced spiral bound units are manufactured. Some prior an equipment is manufactured for use in smaller applications, such as offices, small businesses, or print shops. However, such equipment is expensive, and difficult and time consuming to use. Typically, one piece of equipment is purchased to punch appropriately spaced holes in the stack of papers and a second piece of equipment is purchased to spiral a coil into the stack of punched paper. In spiral binding equipment, such as that disclosed in the Morris patent, an operator manually positions a punched stack of papers so that the holes are positioned in line with a coil placed over a mandrel. The operator then manually starts the end of the coil into the holes in the paper. As described above, the operator then switches on the equipment so that a roller presses the coil against the mandrel, spiraling the coil into the holes in the paper.

During spiraling, it is common for the coil to deform slightly causing it to miss the holes in the paper, resulting in the coil binding or spiraling off the edge of the paper. One of the contributors to coil deformation is the fact that the coil is driven from only one edge of the paper, thus creating greater stresses within the coil as it spirals further along the length of the paper. When the coil binds or spirals off the edge of the paper, the rotation of the roller and coil must be reversed and the coil spiraled backward until it moves back into position. The spiraling process is then repeated until the coil spirals through all of the holes over the length of the stack of papers being bound.

If stacks of different thicknesses are to be bound together as a unit, the operator must maintain different size mandrels on hand. In order to use different size coils, it is necessary for the operator to exchange the mandrels in the apparatus to correspond with the size coil that is being used.

In other spiral binding equipment, the coil is started into the holes at one end of the stack of papers manually. The portion of the coil spiraled into the stack of papers is then pressed against two parallel, rotating rollers that extend along the edge of the stack of papers. As the coil is pressed against the moving rollers, the rollers contact the coil and spiral it into the holes in the paper. This type of spiral binding equipment also deforms the coil, causing it to miss holes in the stack of paper. Thus, an operator must reverse the rotation of the coil, reposition the coil and restart the operation.

Past spiral binding equipment is bulky, difficult to use, expensive, and poorly esthetically designed. In addition, prior spiral binding equipment has a number of moving parts. As with any equipment with moving parts, safety concerns are always an issue.

As can be seen from above, there is a need for improved methods and apparatus to spiral bind a stack of papers together as a unit. One goal of the present invention is to reduce some of the problems associated with prior apparatus and methods thus helping to meet this need.

SUMMARY OF THE INVENTION

The present invention is a spiral binder for inserting a spiral coil into a plurality of holes in a stack of papers in order to bind them together. In one embodiment of the invention, the apparatus includes a coil feeder for rotatably feeding a preformed coil into the holes in the stack of papers. The coil feeder includes a rotatably mounted roller, a drive motor to rotate the roller, a feed shaft radially spaced outward from the surface of the roller, and a plurality of guides extending radially outward from the surface of the feed shaft. The coil is fed onto the feed shaft between the feed shaft and the roller. The roller is biased toward the feed shaft in order to apply a force that presses the roller into the coil and the coil into the feed shaft. The guides are positioned on the feed shaft so that as the coil spirals around the guides, it is fed through the coil feeder.

In accordance with other aspects of the invention, the guides extend radially outward from the surface of the feed shaft at approximately the same pitch as the individual loops of the coil. One end of the roller is tapered to allow the coil to be more easily fed into the coil feeder. The coil feeder also includes a sensor to detect when a coil is inserted into the coil feeder. When the sensor detects that a coil is present, a drive motor rotates the roller, thus feeding the coil into the holes in the stack of paper. The tapered roller automatically starts the rotation of the coil upon insertion of the roller into the spiral binder.

In accordance with still other aspects of the invention, the coil feeder includes a mechanism for detecting when the coil has spiraled through the holes in the stack of papers. The mechanism also provides a coil cutter an indication of when to cut the coil to size. The spiral binder also includes a means for providing the operator an indication of the optimum coil size to be used in binding the stack of papers. The means for providing an operator an indication of coil size includes a paper hold down bar for pressing the stack of papers into contact with the binding platform during binding.

In accordance with other aspects of the invention, the coil binder includes a plurality of locator pins. The locator pins are extendible and retractable. When in an extended position, the locator pins extend through the holes in the stack of papers in order to locate the stack of papers in the proper position on the spiral binder. During binding, the locator pins retract out of the holes in the stack of papers in order to allow the coil to be spiraled through the holes.

An embodiment of a method to perform the steps used in carrying out the present invention is also disclosed.

The present invention eliminates a number of the disadvantages associated with prior art spiral binding methods and apparatus. The coil feeder of the invention allows coils of varying diameters and filament sizes to be used. The invention also properly locates the stack of papers on the binding apparatus to ensure that the coil spirals properly through the holes in the stack of papers. The spiral binding apparatus of the present invention is easy to use, fast, and economical. In addition, the invention provides an operator indications of the proper coil diameter to be used and automatically cuts the coil to the proper length for the stack of papers used.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
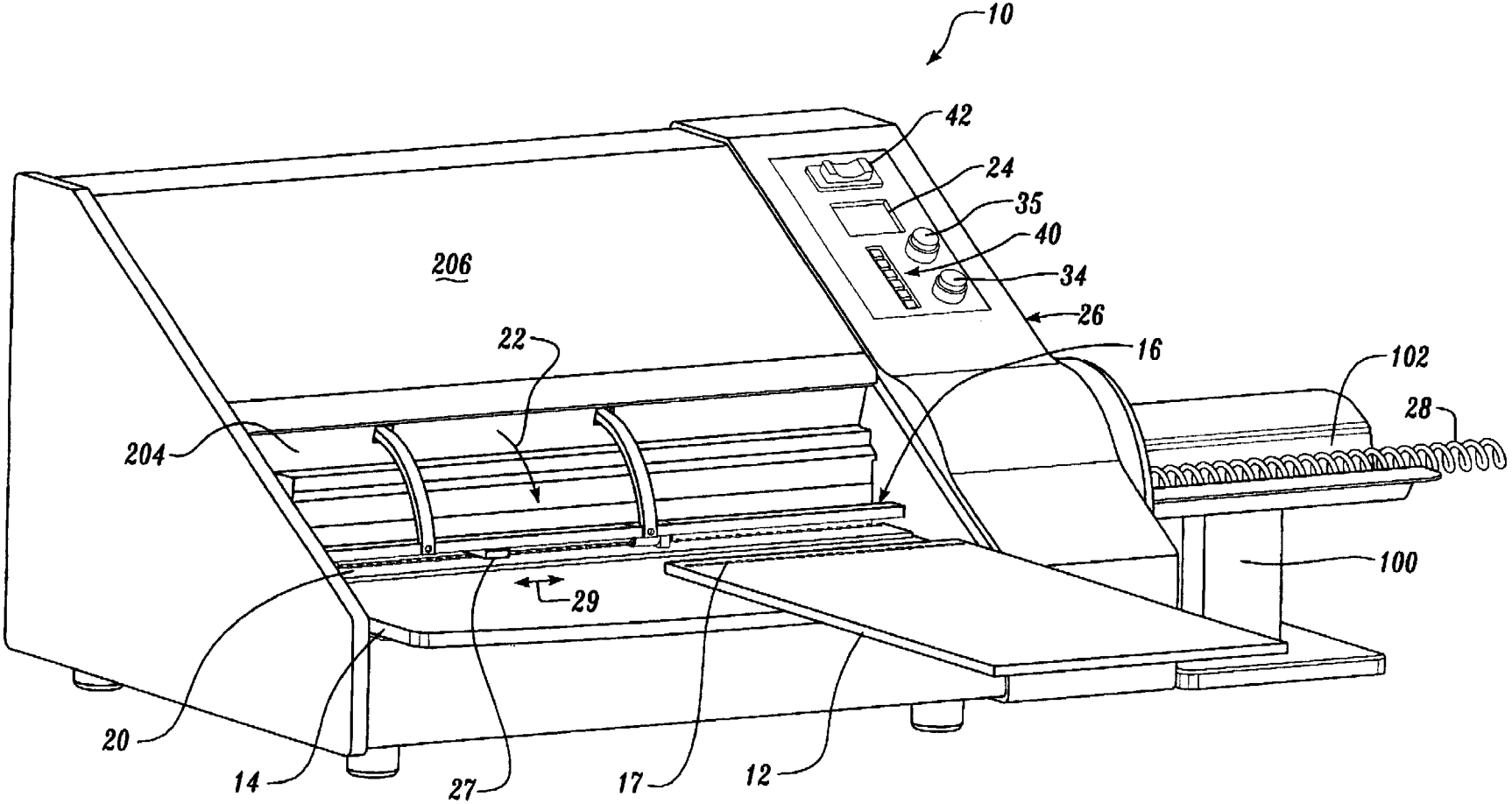
FIG. 1 is a perspective view of a spiral binding apparatus formed in accordance with the present invention.

A spiral binder 10 formed in accordance with the present invention is illustrated in FIG. 1. The overall operation of the spiral binder 10 is first discussed generally below and then the individual structure and operation of the binder is discussed in more detail. The spiral binder 10 is configured to be used with prepunched pages of paper or other flat stock materials. Such pages can be either purchased in a prepunched form or can be punched on location with one of several different punches that are readily commercially available. The punch punches a plurality of equally spaced holes 17 (FIG. 1) along one edge of the stack of papers 12.

Figure 6:
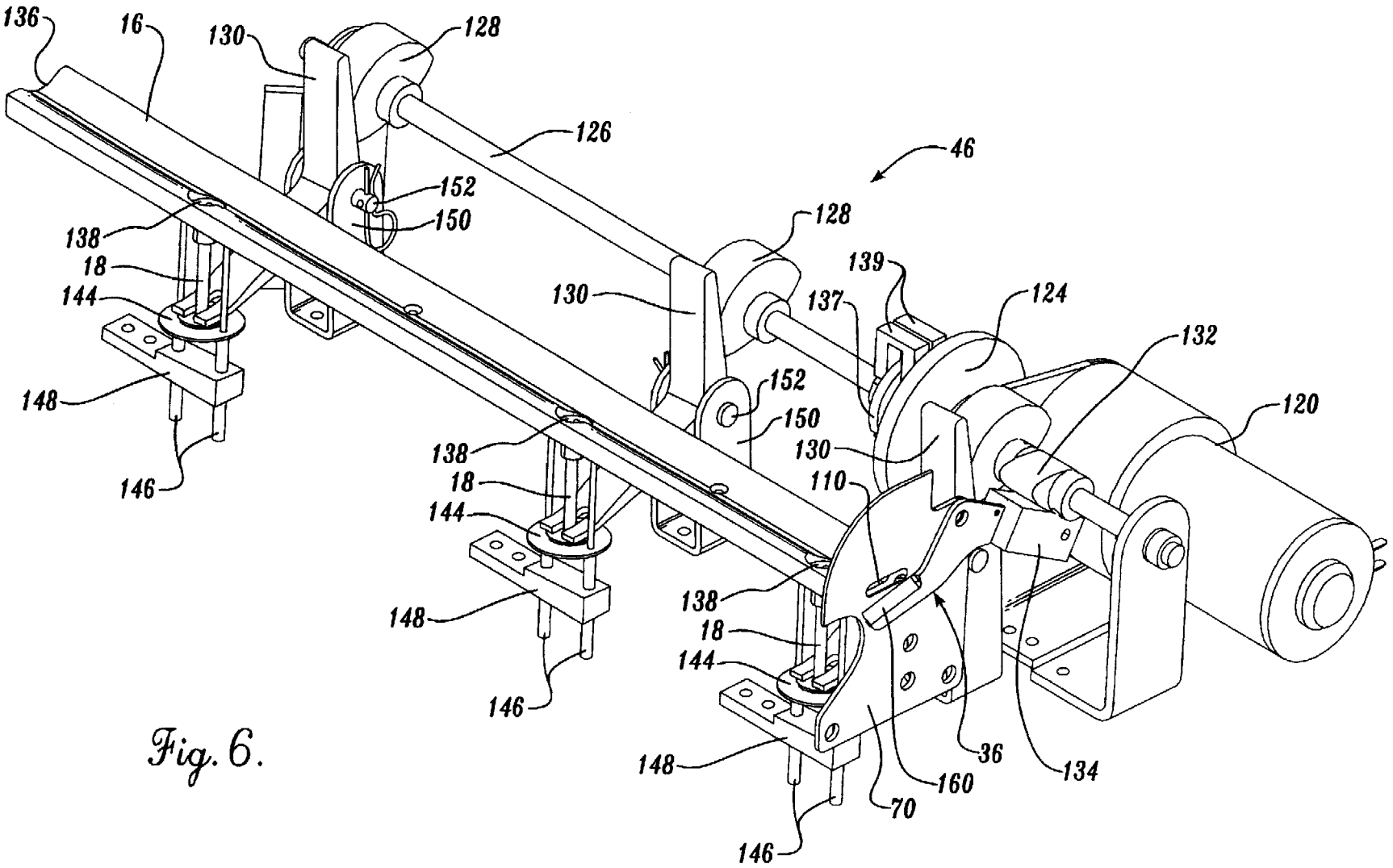
FIG. 6 is a perspective view of the combined pin extension/retraction and coil cutter mechanism.

Once punched, the stack of papers 12 is removed from the punch and placed on the binding platform 14 (FIG. 1) so that the holes 17 in the stack of papers 12 are properly positioned over a guide plate 16 (FIGS. 1 and 6). In the preferred embodiment, a series of locator pins 18 (FIGS. 6–8) extend through the guide plate 16 to assist the operator in properly locating the stack of papers 12 on the guide plate. An operator places the stack of papers 12 over the guide plate 16 so that the locator pins pass through the holes 17 in the stack of papers. Once properly positioned, the operator depresses an advance button 34 (FIG. 1) causing a paper hold down bar 20 (FIGS. 1 and 9–11) to move downward as indicated by arrow 22 (FIG. 1). The hold down bar 20 applies a force on the upper surface of the stack of papers 12 in the direction of the binding platform 14. This downward directed force helps to maintain the stack of papers 12 in position while binding. In addition to holding the stack of papers 12 in position, the hold down bar S/B 20 also provides an indication of the thickness of the stack of papers 12. This indication of thickness is derived from an encoder and decoded by a controller or microprocessor (not shown) to suggest an optimum spiral coil 28 diameter to the operator on an indicator 24 on the from of the housing 26. The operator then selects the proper spiral coil 28 size based on the information provided on the indicator 24.

After the stack of papers 12 is properly positioned on the binding platform 14 and the paper hold down bar 20 is positioned on top of the stack of papers, the operator adjusts a paper sizing slide 27 located on the hold down bar 20. The operator moves the paper sizing slide 27 to the left or right as illustrated by arrow 29 in FIG. 1 until it is positioned adjacent to the left edge of the stack of papers 12. Once positioned, during operation of the spiral binder 10, the sizing slide 27 provides an indication of when the spiral coil 28 has spiraled through all of the holes 17 in the stack of papers 12, as described below. This indication is used by a microprocessor in the spiral binder to determine when to stop feeding the spiral coil 28 into the stack of papers and when to cut the right end of the coil to size.

Figure 2:
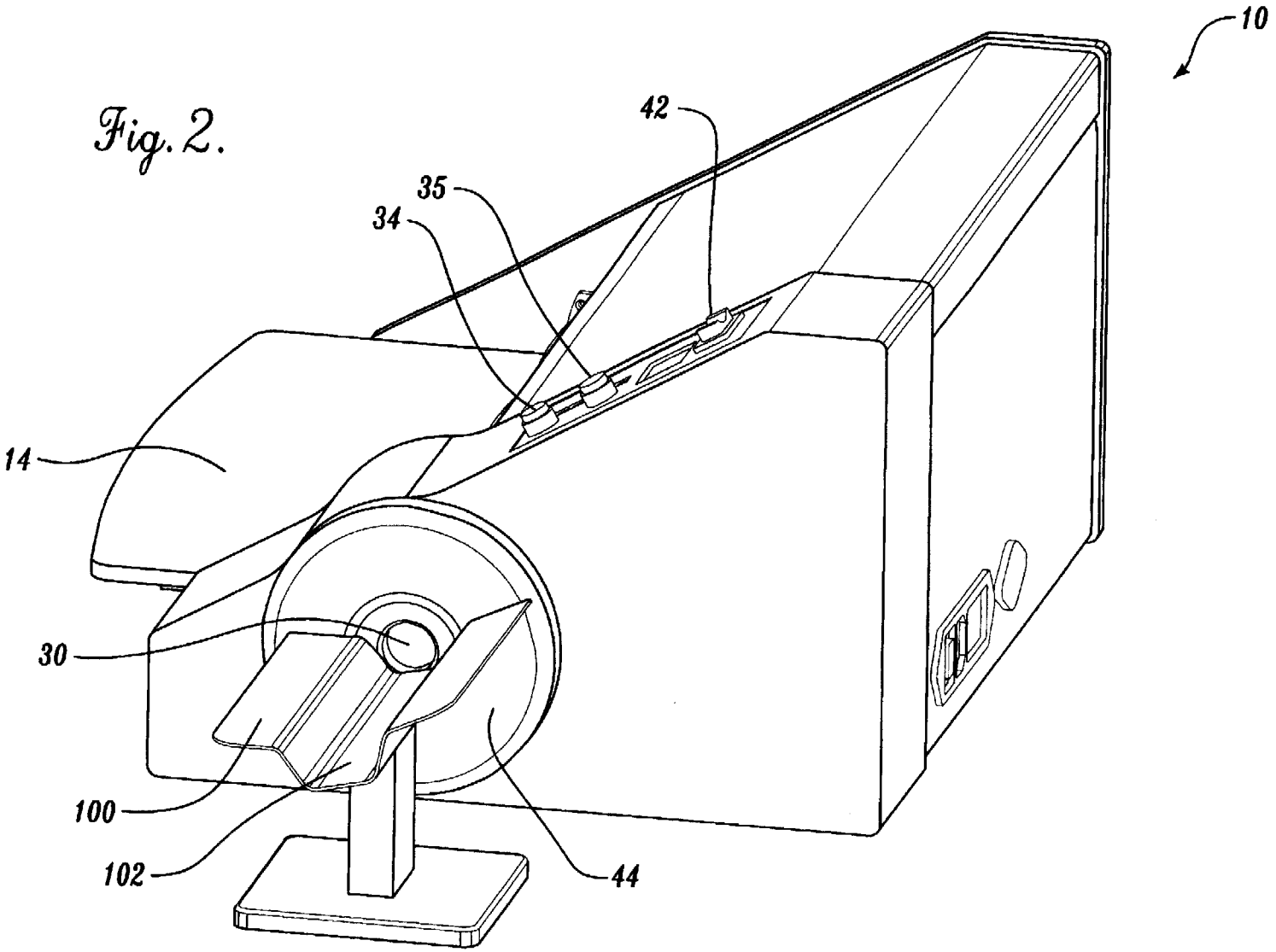
FIG. 2 is another perspective view of the spiral binding apparatus of FIG. 1.

After setting the sizing slide 27, the operator inserts a spiral coil 28 (FIG. 1) into an aperture 30 (FIG. 2) in the right side of the spiral binder 10. The spiral binder 10 may be operated either in an automatic mode or in a manual mode. In the manual mode, after inserting the coil 28, the operator depresses the advance button 34. This causes the coil feeder 32 (FIG. 3) to spiral the coil 28 through the holes 17 in the stack of papers 12 (FIG. 1), thus binding the stack of papers 12 together as a unit. In the automatic mode, the spiral binder 10 automatically spirals the coil 28 into the stack of papers 12 after insertion of the coil into the aperture 30 in the side of the spiral binder. In the preferred embodiment of the invention, the operator may either control the operation of spiral binder 10 by depressing the advance button 34 or by depressing a foot pedal (not shown) hooked to the spiral binder.

Once the coil 28 is fed through the holes 17 in the stack of papers 12, the left end of the coil as shown in FIG. 1 contacts one end of the sizing slide 27 as described below. This triggers an on/off switch 180 (FIG. 11) causing the spiral binder 10 to stop feeding the spiral coil 28 into the stack of papers 12. The on/off switch 180 also triggers a coil shearing mechanism 36 (FIG. 6). The coil shearing mechanism 36 cuts the spiral coil 28 to size by cutting off the coil 28 adjacent to the right edge of the stack of papers 12. After the coil 28 is cut to size, the operator depresses the advance button 34, causing the hold down bar 20 to raise. The bound stack of papers 12 can then be removed from the spiral binder 10.

In addition to the features identified above, the spiral binder 10 includes a plurality of status indicator lights 40 (FIG. 1) that indicate when the binder is ready to receive the stack of papers 12, when the stack of papers is sized, when the spiral binder is ready to receive a spiral coil 28, when the binder is ready to insert the coil into the stack of papers, when the spiral binder is ready to cut the coil, and when the binding operation is complete. The spiral binder 10 also includes a cancel button 35 that stops the operation of the spiral binder 10 and returns it to a home position as described below. In the home position, the spiral coil 28 is retracted, the hold down bar 20 is raised and the locator pins 18 are extended. The spiral binder 10 also includes a coil insertion switch 42 that is used to set the spiral binder to spiral the coil 28 into or out of the sack of papers 12, depending on the setting of the switch.

Figure 7:
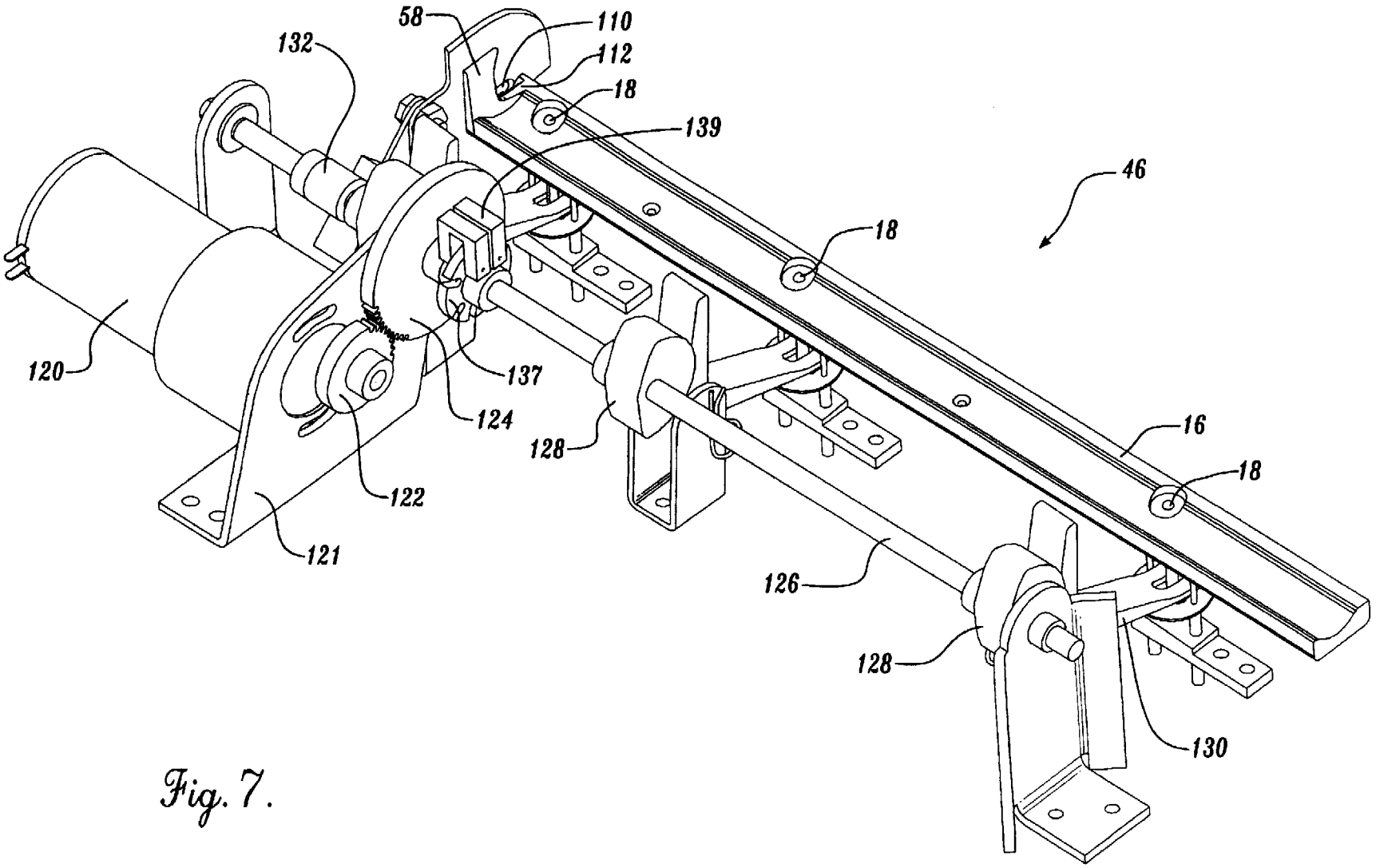
FIG. 7 is another perspective view of the combined pin extension/retraction and coil cutter mechanism.
Figure 8:
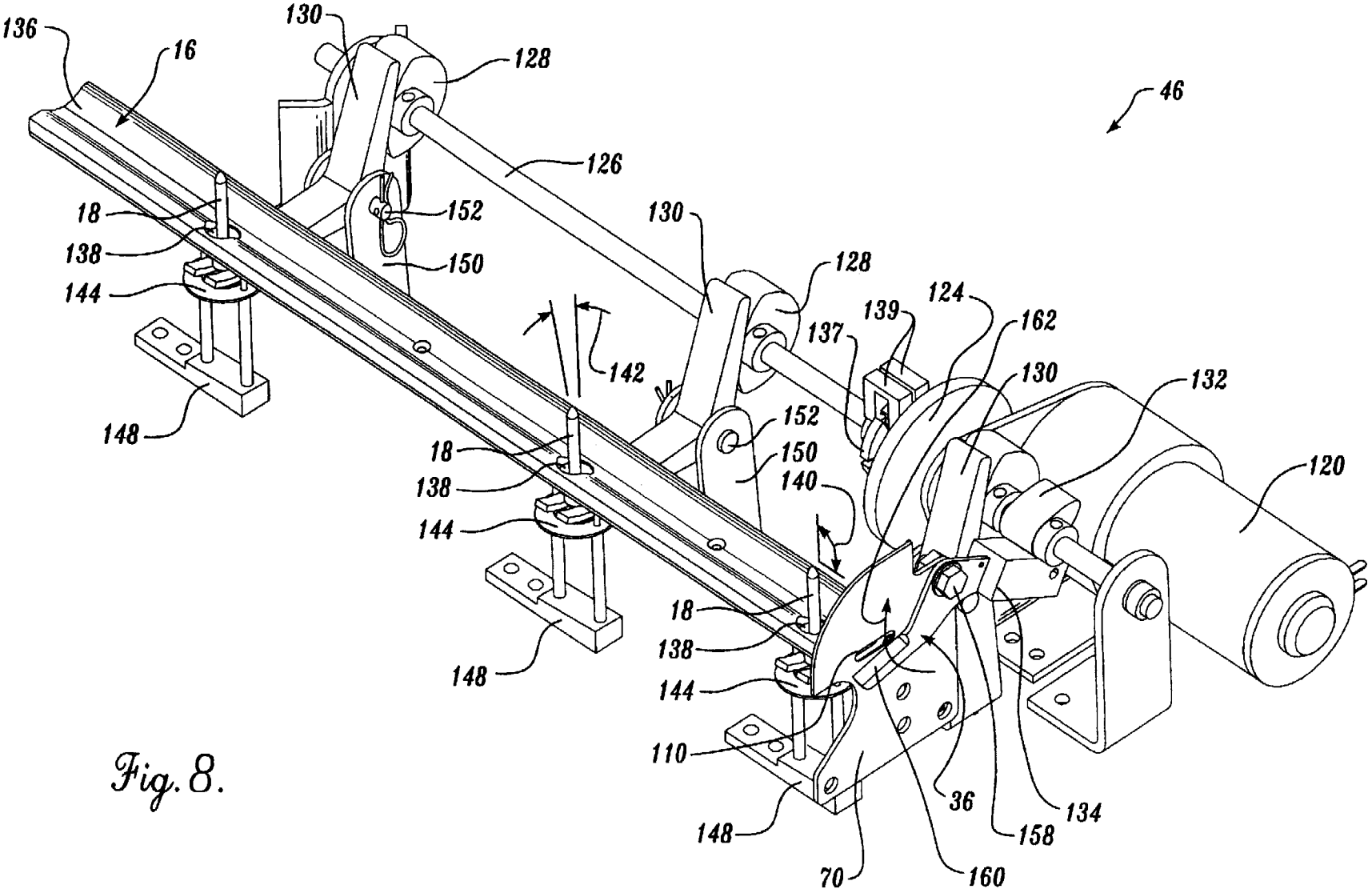
FIG. 8 is yet another perspective view of the pin extension/retraction and coil cutter mechanism.

The individual parts and operation of the spiral binder 10 will now be described in more detail. The spiral binder 10 consists of a number of different operational mechanisms including a housing 26 (FIG. 1), a coil feeder 32 (FIGS. 3 and 4), a paper hold down and sizing mechanism 44 (FIGS. 9–11) and a combined pin extension/retraction and coil cutter mechanism 46 (FIGS. 6–8).

The housing 26 (FIGS. 1 and 2) of the spiral binder 10 is formed of sheet metal, injection molded plastic, or other appropriate materials. The housing 26 is sized to contain and support the internal mechanical parts of the spiral binder 10 and to provide a functional and pleasing exterior appearance.

Figure 3:
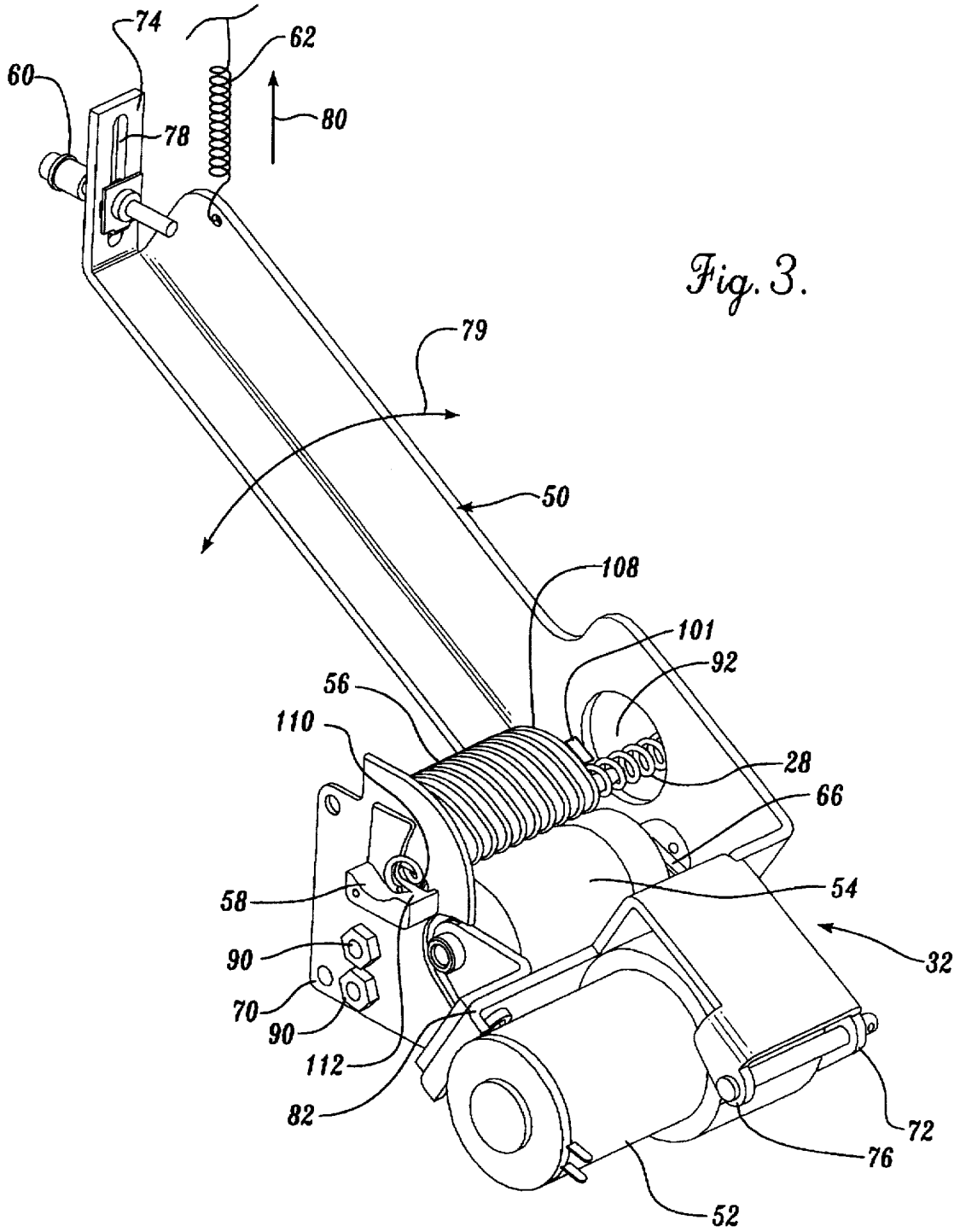
FIG. 3 is a perspective view of the coil feeder and coil guides of the apparatus of FIG. 1.
Figure 4:
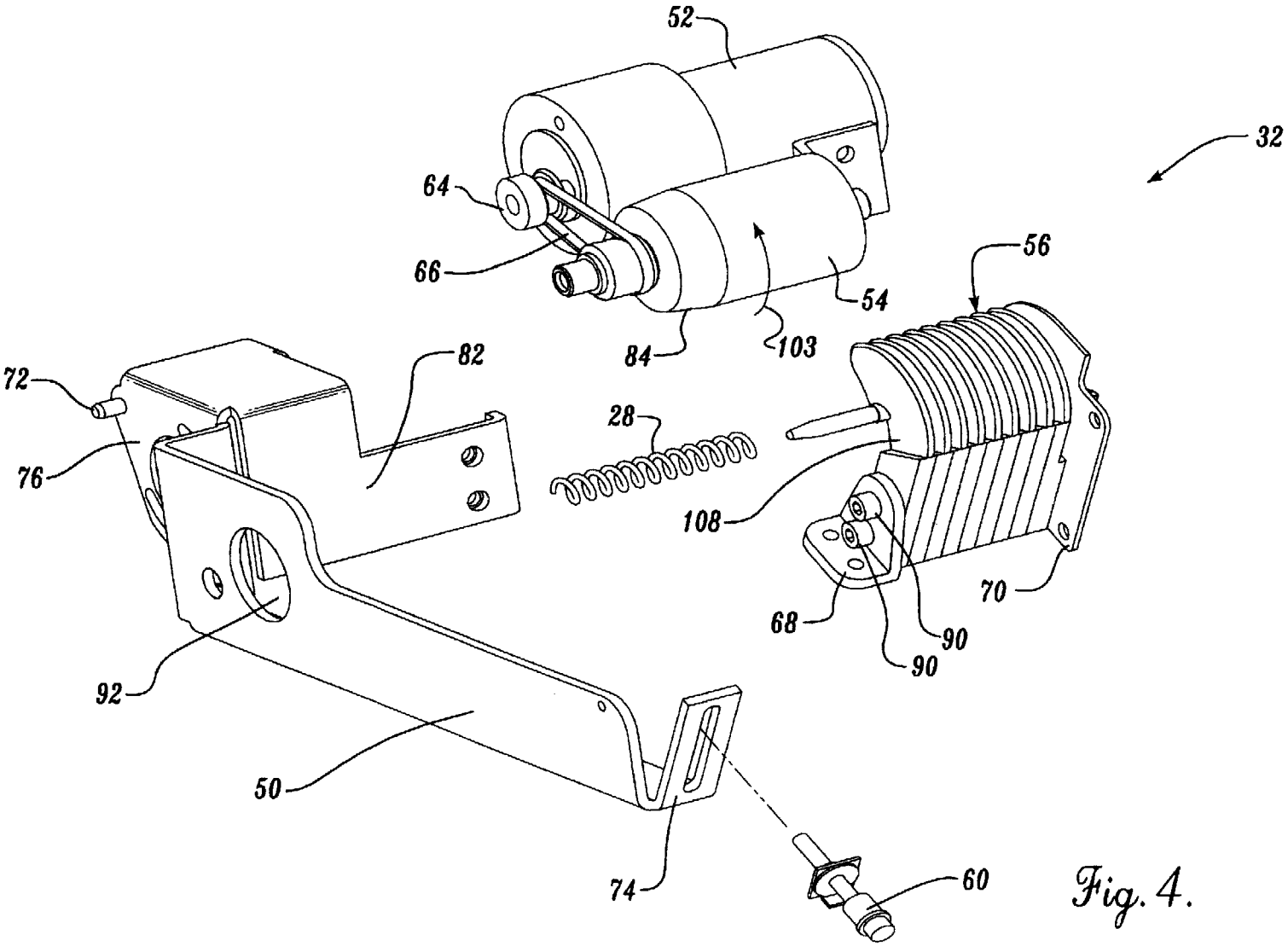
FIG. 4 is a partially exploded view of the coil feeder and coil guides of the apparatus of FIG. 1.

The coil feeder 32 (FIGS. 3–5) is positioned within the housing 26 adjacent to the right end of the housing as illustrated in FIG. 1. The coil feeder 32 includes a mounting bracket 50 (FIG. 3), a coil drive motor 52, a drive roller 54, a plurality of coil vanes or guides 56, a coil spreader 58, a binding adjustment screw 60, a biasing means 62, a drive pulley 64 (FIG. 4), a drive belt 66, right and left mounting brackets 68 and 70, and a feed shaft 86 (FIG. 4).

The front of the mounting bracket 50 is pivotally mounted to the interior of the front of the housing 26 through the use of a pivot pin 72. The pivot pin 72 passes through two flanges 76 that extend downward from the lower edge of the mounting bracket 50 and also through a flange (not shown) on the interior of the housing 26. This configuration allows the mounting bracket 50 to pivot around the pivot pin 72 as illustrated by arrow 79 (FIG. 3). The rear end 74 of the mounting bracket 50 is slidably mounted to the upper right corner of the housing 26 through the use of the adjustment screw 60. The adjustment screw 60 is mounted to the upper rear edge of the housing 26 and extends through a slot 78 in the rear end 74 of the mounting bracket 54. The rear end 74 is also attached to the top of the housing 26 through the use of the biasing means 62. In the preferred embodiment, the biasing means 62 is a tension spring that is attached to the rear end 74 of the mounting bracket at one end and the top of the housing 12 at the other end.

The combination of the pivot pin 72 and slidably mounted adjustment screw 60 allow the mounting bracket 50 to rotate to the extent allowed by the slot 78 as illustrated by arrow 80. As described in detail below, this movement allows the coil feeder 32 to account for differing spiral coil diameters and coil filament diameters. The spring biasing means 62 biases the rear end 74 of the mounting bracket 50 upward as illustrated by arrow 80. This biasing action maintains the roller 54 in contact with the spiral coil 28 as it is inserted into the coil feeder 32 as described in more detail below.

The drive motor 52 is mounted on one side of a flange 82 (FIG. 4) that extends from right to let inward from the edge of the mounting bracket 50 adjacent to the right end of the housing 12. The drive roller 54 is rotatably mounted to the opposite side of the flange 82.

A drive pulley 64 is attached to the shaft of the drive motor 52. The drive belt 66 extends around the drive pulley 64 and around a pulley on a shaft running through the center of the drive roller 54. Rotation of the drive motor 52 causes a corresponding rotation of the drive roller 54. As illustrated in FIG. 4, the right end 84 of the drive roller 54 adjacent the aperture 30 in the housing 12 slopes inward so that the drive roller 54 has a smaller diameter at the end adjacent to the aperture 30 than in the center or opposite end. The tapered end 84 of the drive roller 54 allows the coil feeder 32 to automatically grasp and begin feeding the spiral coil 28 through the coil feeder as described in more detail below.

In the preferred embodiment, it was found to be advantageous that the taper on the roller be approximately eight and a half degrees plus or minus five degrees. It was also found advantageous to locate the knee between the tapered end 84 of the drive roller and the rest of the drive roller. Approximately in line with the first guide 108 (FIG. 3).

Figure 5:
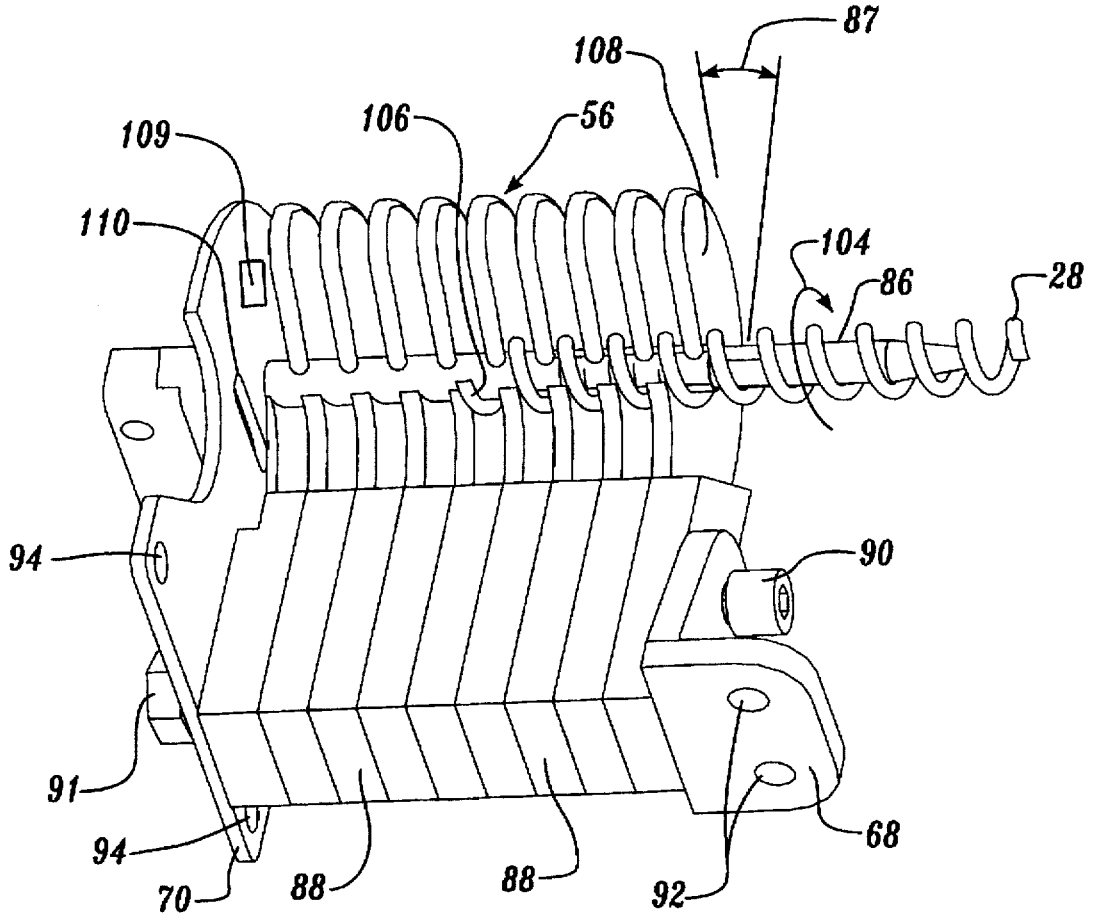
FIG. 5 is an enlarged, perspective view of the coil guides.

The coil vanes or guides 56 are best illustrated in FIG. 5. Each guide 56 spirals at least partially around the centrally located feed shaft 86. Each guide 56 spirals around the feed shaft 86 and extends radially outward from the circumference of the feed shaft such that the vanes are sloped at an angle 87 of approximately the same pitch as the spiral coil 28 used in the spiral binder 10. In the preferred embodiment, the guides 56 are formed as separate pieces and are attached together at their lower ends 88 by two fasteners such as bolts 90. The bolts 90 extend through the right mounting bracket 68, through the lower ends 88 of the guides 56 and through the right mounting bracket 70. The opposite ends of the bolts 90 are secured by nut 91. The right and left mounting brackets 68 and 70 are in turn attached to the bottom of the housing 26 through the use of fasteners that extend through holes 92 and 94 in the right and left mounting brackets 68 and 70 respectively. Thus, the guides 56 and feed shaft 86 are rigidly mounted to the housing 26 while the mounting bracket 50 is pivotally mounted to the housing as described above.

In the preferred embodiment, as illustrated in FIG. 5, the guides 56 extend approximately two-thirds of the way around the circumference of the feed shaft 86. This allows the drive roller 54 to be placed in proximity with the feed shaft 86 as best illustrated in FIG. 3. When the mounting brackets 50, 68 and 70 are attached to the housing 26, the drive roller 54 is located just below the free end of the guides 56 in close proximity with or touching the feed shaft 86. When mounted in the housing 26, the right end of the feed shaft 86 extends a distance to the right of the first guide 108 and through a circular aperture 92 in the mounting bracket 50. The aperture 92 and feed shaft 86 are positioned so that they are aligned with the aperture 30 in the right side of the housing 26.

During operation of the spiral binder 10, a spiral coil 28 is placed within the aperture 30 and 92 such that the left end of the coil is placed around the right end of the feed shalt 86 as illustrated in FIGS. 3–5. In order to assist an operator in properly positioning the coil 28, a coil rest 100 (FIGS. 1–2) can be utilized. The coil rest 100 is placed adjacent the right side of the housing 26 in line with the aperture 30. The top of the coil rest 100 includes a trough 102 that is sized and aligned with the aperture 30. The trough 102 positions the coil 22 at the right height and lateral position to allow the coil to be inserted into the aperture 30 over the feed shaft 86.

As the coil 28 is placed over the feed shaft 86 and pushed inward, it triggers a sensor 101 (FIG. 3) mounted on the interior of the mounting bracket 50. The sensor 101 senses the presence of the coil 28 and provides an indication of the coil's presence to the controller or microprocessor (not shown). The microprocessor in turn is connected to the motor 52 and causes the motor to rotate the drive roller 54 counterclockwise as illustrated by arrow 103 in FIG. 4.

The sensor 101 may be of either a mechanical or optical type. For example, the sensor 101 could be a photoelectric diode or a mechanical switch.

As the spiral coil 28 is pushed further inward, it contacts the tapered end 84 (FIG. 4) of the rotating roller 54 as best illustrated in FIG. 3. The rotation of the drive roller 54 causes the coil 28 to rotate clockwise around the feed shaft 86 as illustrated by arrow 104 in FIG. 5. This rotational movement causes the free end 106 of the coil 28 to spiral around the first guide 108. The pitch of the first guide 108 in turn causes the coil 28 to spiral inward around the successive guides 56.

As the free end 106 of the coil 28 nears the left mounting bracket 70 it triggers a second sensor 109 located on the right side of the mounting bracket 70. The sensor 109 detects the presence of the end of the coil 28 and passes an indication of the coil's presence to the microprocessor. If the spiral binder 10 is operating in a manual mode, the microprocessor stops rotation of the motor 52 and waits for the operator to depress the advance button 34 (FIG. 1) prior to spiraling the spiral coil into the stack of papers 12. If the spiral binder 10 is operating in an automatic mode, the movement of the motor 52 and thus drive roller 54 continues until the coil 28 is spiraled through the holes 17 in the stack of papers 12 as described below.

Once the coil 28 spirals from right to left through all of the guides 56, the free end 106 spirals through a horizontal slot 110 in the left mounting bracket 70 (FIGS. 3, 5, and 6). As best illustrated in FIG. 3, as the free end 106 of the coil spirals through the slot 110, it spirals around a coil spreading bracket 58. The coil spreading bracket 58 includes a spreading wedge 112 that spreads the first coil of the spiral coil slightly so that the free end 106 is directed into the first hole at the right side of the stack side of papers 12.

The spiral binder 10 continues to spiral the coil 28 through the holes 17 and stack of papers 12 until the coil reaches the left edge of the stack of papers as described below. The coil 28 is then cut off at the slot 110 by the coil cutter 34 also as described below.

The tapered end 84 of the drive roller 54 allows the drive roller to engage and start to spiral the coil 28 through the guides 56 regardless of the coil diameter or filament size used. In addition, the pivotal mounting of the mounting bracket 50 and, thus, roller 54 also allows the coil feeder 32 to account for coils 28 of different diameters and filament sizes.

As described above, the surface of the roller 54 is positioned adjacent the surface of the feed shaft 86. The biasing force of the biasing means 62 (FIG. 3) biases the roller 54 upward such that the surface of the roller 54 is biased into the surface of the feed shaft 86. As a coil 28 is fed onto the feed shaft 86, it spirals around the guides 56 in between the surface of the roller 54 and the surface of the feed shaft 86. As the coil 28 spirals from right to left on the feed shaft 86, the mounting bracket 50 moves downward slightly against the biasing force of the spring 62 in order to provide clearance for the coil 28. Thus, the biasing force of the biasing means 62 maintains the surface of the drive roller 54 in contact with the surface of the coil 28. In addition, the biasing force of the biasing means 62 ensures that the spiral coil 28 is firmly pressed upward into the feed shaft 86 by the roller 54. Spiral coils 28 having filaments of greater diameters cause the roller 54 to be displaced a greater distance downward away from the feed shaft 86, thus allowing the greater filament size coil to move between the roller 54 and feed shaft 86. Similarly, when a coil 58 of smaller diameter filaments is used, the biasing force of the spring 62 presses the roller 54 upward, thus accounting for the smaller diameter of the coil filament. Therefore, the coil feeder 32 of the present invention automatically accounts for varying filament diameters.

The feeding action of the coil feeder 32 is partially dependent on the drive roller 54 pressing the portion of the coil 28 in contact with the drive roller against the feed shaft 86. The feeder action is not dependent upon contact between the coil 28 and feed shaft 86 at other locations, thus, the action of the coil feeder is not dependent upon the use of a coil of a specific diameter.

In the preferred embodiment, the roller 54 is formed of a pliable rubber or plastic material that deforms slightly upon contact with the coil 28. The pliable surface of the drive roller 54 allows the roller to obtain a good grip on the spiral coil 28, thus helping to assure that the coil spirals through the guides 56, slot 110, and holes 17 in the stack of papers 12. The minimum clearance between the roller 54 and feed shaft 86 is adjusted by adjusting the adjustment screw 60. Adjusting the adjustment screw 60 changes the maximum allowed upward movement of the free end 74 of the mounting bracket 50. This allows the operator to fine tune the interaction between the drive roller 54 and spiral coil 28 to insure that the coil spirals through the stack of papers 12.

As the spiral coil 28 spirals through the slot 110 it enters the combined pin retraction and coil cutter mechanism 46, illustrated in FIGS. 6–8. The pin retraction and coil cutter mechanism 46 includes a drive motor 120, drive gear 122, reduction gear 124, cam shaft 126, cam lobes 128, levers 130, guide plate 16, locator pins 18, cutter lobe 132, coil cutter 134, and guide shafts 146.

As best seen in FIG. 6, the guide plate 16 is located at the rear of the binding platform 14 and extends across the width of the binding platform. The guide plate 16 has a concave upper surface 136 (FIG. 6). As the coil 28 exits the slot 110 and spirals into the holes 17 in the paper stack 12, it moves over the width of the guide plate 16 within the concave surface 136. The concave surface 136 helps to guide the spiral coil 28 and maintain it in the proper position as it spirals through the holes 17 in the papers 12.

The locator pins 18 are spaced over the length of the guide plate 16 and extend through correspondingly located apertures 138 in the guide plate 16. Prior to beginning binding, the locator pins 18 are extended through the apertures 138 as described below. The stack of papers 12 is then placed and located in the proper position on the guide plate 16 and binding platform 14 through the use of the locator pins 18. The stack of papers is placed on the binding platform 14 such that the locator pins 18 pass through the holes 17 in the stack of papers 12 as illustrated in FIG. 8. However, if the locator pins 18 remained extending through the holes 17 in the stack of papers, they would interfere with the spiral coil 28 passing through the holes in the papers. Thus, once the papers 12 are in position, and the paper hold down bar 20 is in place (as described below), the locator pins 18 are retracted. As illustrated in FIG. 6 when retracted, the top of the locator pins 18 are located below the concave surface 136 of the guide plate 16.

In order to properly locate the stack of papers so that the coil 28 may be easily spiraled through the holes 17, the pins 18 are mounted at an angle with respect to the surface of the guide plate 16. As illustrated in FIG. 8, the guide pins 18 are angled from right to left as illustrated by arrow 140 at approximately the same angle as the loops of the coil 28. In addition, the pins are angled slightly forward as illustrated by arrow 142 in order to assist the curved free end of the coil 28 in passing through the holes 17.

Each of the locator pins 18 is mounted on a circular support base 144. Each support base 144 is in turn slidably mounted upon two guide shafts 146. The guide shafts 146 are mounted to the bottom of housing 26 by mounting brackets 148 using fasteners or other appropriate fastening means. Each guide shaft 146 extends upward from a mounting bracket 148 and is attached to the lower surface of the guide plate 16 at the opposite end. Each guide pin shaft 146 also extends through correspondingly sized hole in the base 144. This configuration allows each base 144 to move up and down toward and away from the lower surface of the guide plate 16 while supporting the locator pins 18 in the proper position.

Each locator pin 18 and base 144 is attached to one end of an L-shaped lever 130. The fulcrum of each lever 130 is rotatably mounted in between the forks of a U-shaped support bracket 150 by a pivot pin 152. Each support bracket 150 is in turn mounted to the bottom of the housing 26. The opposite end of each lever 130 engages one of the cam lobes 128. Each cam lobe 128 is mounted upon the cam shaft 126 that extends approximately parallel to the guide plate 16. A gear 124 is mounted on the right end of the cam shaft 126 adjacent the mounting bracket 121 (FIG. 7).

The drive motor 120 is attached to the bottom of the housing 26 by a mounting bracket 121 so that the drive gear 122 attached to the shaft of the drive motor is approximately in line with the gear 124. The gear 122 engages the gear 124 attached to the cam 126. An encoder wheel 138 (FIGS. 7 and 8) is also mounted on the cam shaft 126. The encoder wheel 138 passes through a sensor 139 that is connected to the microprocessor that operates the spiral binder.

After the stack of papers 12 is properly positioned on the binding platform 14 as described above, the microprocessor causes the drive motor 120 and thus gears 122, 124 and optical encoder 138 and cam shaft 126 to rotate. As the cam shaft 126 rotates, the cam lobes 128 also rotate. As the cam lobes 128 rotate, they contact one end of the levers 130 causing them to pivot about pivot pins 152 thus extending or retracting the locator pins 18. As the optical encoder 137 rotates, the sensor 139 provides positional information to the microprocessor. This positional information is used by the microprocessor to shut off the motor 120 when the locator pins 18 are either fully extended or fully retracted. The optical encoder 137 also provides positional information regarding the position of the coil cutter 134 as described below.

The fulcrum of the coil cutter 134 (FIG. 8) is pivotally attached to the left mounting bracket 70 by a pivot pin 158. One end of the coil cutter 134 extends forward from the pivot pin 158 and includes a beveled cutting blade 160. When in a retracted position, the cutting blade 160 is located directly beneath the slot 110. The opposite end of the coil cutter 134 extends rearward and engages a cutter lobe 132 also mounted upon the cam shaft 126. When instructed, the drive motor 120 drives the cam shaft 126, thus causing the cutter lobe 132 to engage the rearward end of the coil cutter 134. This causes the coil cutter 134 to pivot around pivot pin 158, moving the cutting blade 160 clockwise as illustrated by arrow 162 (FIG. 8). The clockwise movement of the cutting blade 160 causes the cutting blade to move upward over the slot 110, thus shearing the coil 28 at the slot 110.

Figure 9:
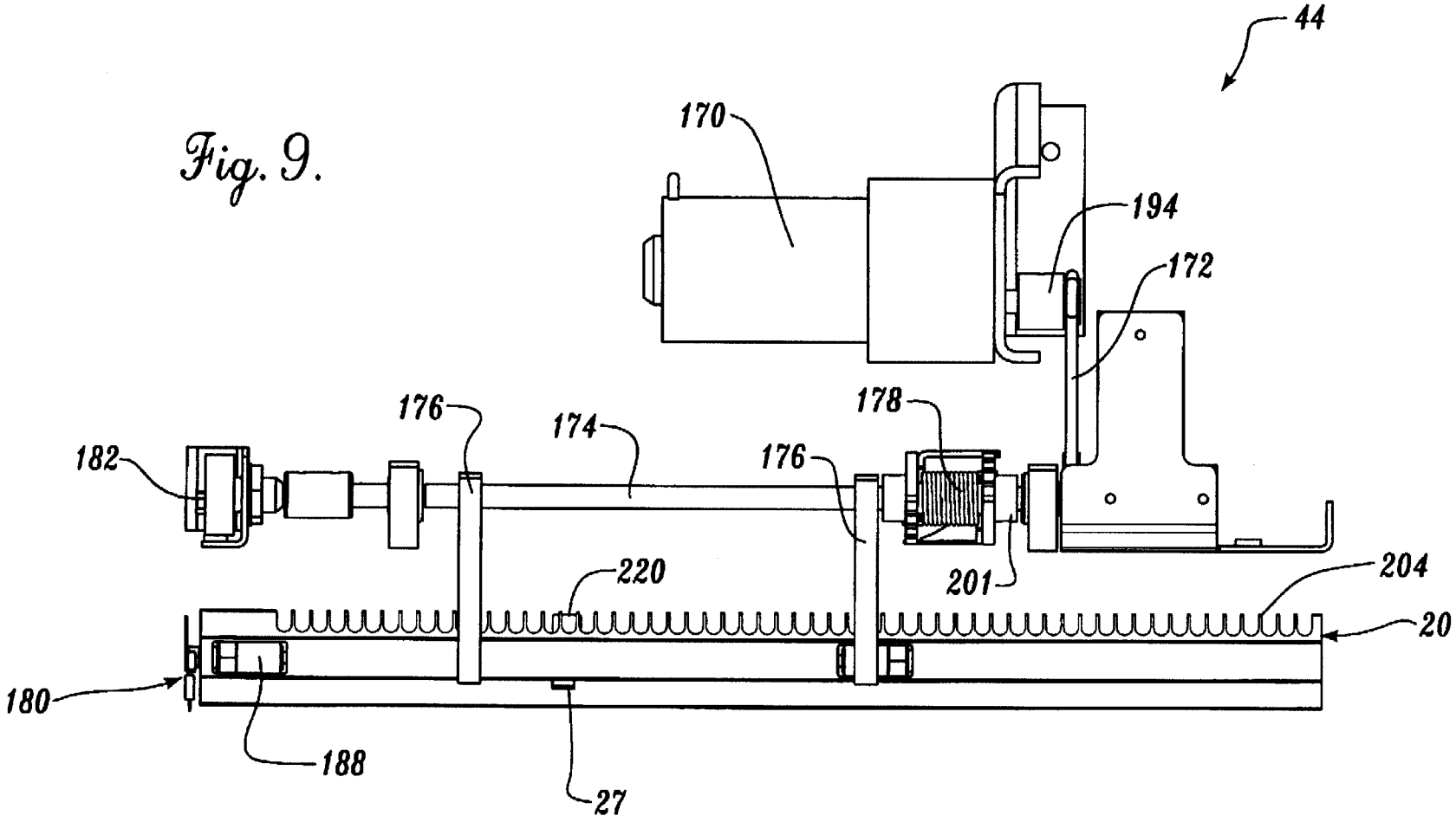
FIG. 9 is a top view of the paper hold down and sizing mechanism.

The paper hold down and sizing mechanism 44 will now be described by reference to FIGS. 9–11. The paper hold down and sizing mechanism 44 includes a drive motor 170, shaft 174, two support arms 176, a spring clutch 178, a hold down bar 20, a position sensor 182, and paper sizing mechanism 184 (FIG. 11). The paper sizing mechanism 184 includes a drive shaft 186, two bearings 188, the sizing slide 27, an on/off switch 180, and a cover plate 190.

The drive motor 170 is attached to a support flange 192 (FIG. 10) that is in turn mounted to the bottom of the housing 26. The drive motor 170 is also connected to the spiral binders microprocessor (not shown). A drive pulley 194 is mounted on the drive shaft of the motor 170. The drive belt 172 extends around the drive pulley 194 and also extends around a pulley 196 mounted upon a rotatably mounted shaft 201. The left end of the shaft 201 is connected to the spring clutch mechanism 178 (FIGS. 9 and 10). The opposite end of the spring clutch mechanism 178 is connected to the shaft 174. The arms 176 (FIGS. 10 and 11) are attached to the shaft 174 at one end and extend radially outward from the shaft. The arms 176 then arc downward and are connected to a U-shaped cover plate 190 by fasteners (not shown) that pass through the arms 176 and cover plate 190. The cover plate 190 is in turn attached to the bearings 188 by fasteners not shown. The bearings 188 are spaced laterally apart and are attached to the hold down bar 20 using fasteners not shown).

The shaft 174 is rotatably mounted within laterally spaced bearings 200 that are attached to the internal structure of the housing 26. Rotation of the motor 170 causes the shaft 174 to rotate. This in turn causes the arms 176 and thus hold down bar 20 to arc radially upward or downward as illustrated by arrow 202 (FIG. 10). In its retracted position (not shown) the hold down bar 20 is raised away from the binding platform 14 and retracted within a recess 204 in the front panel 206 of the housing 26 (FIG. 1). In its lowered position as shown in FIGS. 1 and 10, the hold down bar 20 moves downward toward the binding platform 14 on top of the stack of papers 12. When in its lowered position, the hold down bar 20 exerts a downward directed force approximately normal to the surface of the binding platform 14 on the stack of papers 12. This downward directed force maintains the stack of papers 12 in position during binding. The motor 170 is connected to the drive shaft 174 through the spring clutch 178 in order to allow for stacks of paper 12 of varying thickness. The spring clutch 178 allows the shaft 201 to rotate slightly with respect to the shaft 174. Thus, when stacks of paper 12 of greater thicknesses are inserted in the spiral binder 10, the hold down bar 20 is capable of placing a downward directed force on the stack of papers without binding the motor 170.

It is important that the portion of the stack of papers 12 surrounding the holes 17 be maintained in position on the binding platform 14 during binding. Therefore, the rear edge of the hold down bar 20 includes a plurality of comb-like teeth 204 (FIGS. 9 and 10) that extend rearward from the rear edge of the hold down bar. Each of the teeth 204 are positioned to extend between the holes 17 in the stack of papers 12. Thus, the teeth 204 provide a downward directed force on the stack of papers 12 while not interfering with the spiraling motion of the spiral coil 28 through the holes 17.

In addition to holding the stack of papers 12 in place during binding, the hold down and sizing mechanism 44 also provides the user an indication of the thickness of the stack of papers being bound. The indication of the thickness of the stack of papers is provided by the sensor 182 connected to the left end of the shaft 174. As the shaft 174 rotates, it also rotates the sensor 182. In the preferred embodiment, the sensor 182 is a dash pot. The dash pot 182 is connected to the spiral binder's microprocessor. As the shaft 174 rotates, it rotates the dash pot 182 thus changing the electrical resistance of the dash pot. The change in resistance of the dash pot 182 is detected by the microprocessor. This change in resistance is used by the microprocessor to determine the position of the shaft 174 and thus the thickness of the stack of papers 12.

In alternate embodiments of the invention, the sensor 182 could be an encoder wheel or other form of position sensing device.

The elements of the paper sizer 184 are also mounted on the hold down bar 20. The paper sizer 184 is used to provide an indication to the microprocessor of the spiral binder of when the spiral coil 28 has spiraled through all of the holes 17 in the stack of papers 12. As illustrated in FIG. 11, the paper sizer 184 includes the bearings 188, the rotatably mounted shaft 186, the sizing slide 27, a lobed cam 210 and the on/off switch 180.

The shaft 186 is rotatably mounted within the bearings 188 between the hold down bar 20 and the cover plate 190. The sizing slide 27 is slidably mounted on the shaft 186. The sizing slide 27 is mounted on the shaft 186 so that it may slide along the length of the shaft as illustrated by arrow 212. However, the sizing slide 27 is mounted to the shaft 186 such that rotation of the sizing slide 27 causes a corresponding rotation of the shaft 186.

The lobed cam 210 is attached to the left end of the shaft 186. Rotation of the shaft 186 causes a corresponding rotation of the lobed cam 210. As best illustrated in FIGS. 10 and 11, the on/off switch 180 includes a deformable trigger 216 and a microswitch 214. The deformable trigger 216 is mounted on the left wall of the housing 26. A portion of the deformable trigger 216 extends upward and contacts the lobed cam 210. The microswitch 214 is also attached to the left wall of the housing 26 and is positioned so that the switch is in line with the upward extending portion of the deformable trigger 216.

After the stack of papers 12 has been placed within the spiral binder 10 and the hold down bar 20 is in place, the operator slides the sizing slide 27 to the right as illustrated in FIG. 1 until it contacts the left edge of the stack of papers 12. As the coil 28 completes its spiraling motion through the holes 17, the free end of the spiral coil exiting the left-most hole 17 contacts the rear edge 220 (FIG. 9) of the sizing slider 27. The spiraling motion of the coil 28 pushes the rear edge of the sizing slider 27 upward thus rotating the shaft 186 clockwise as illustrated by arrow 222 (FIG. 11).

Figure 10:
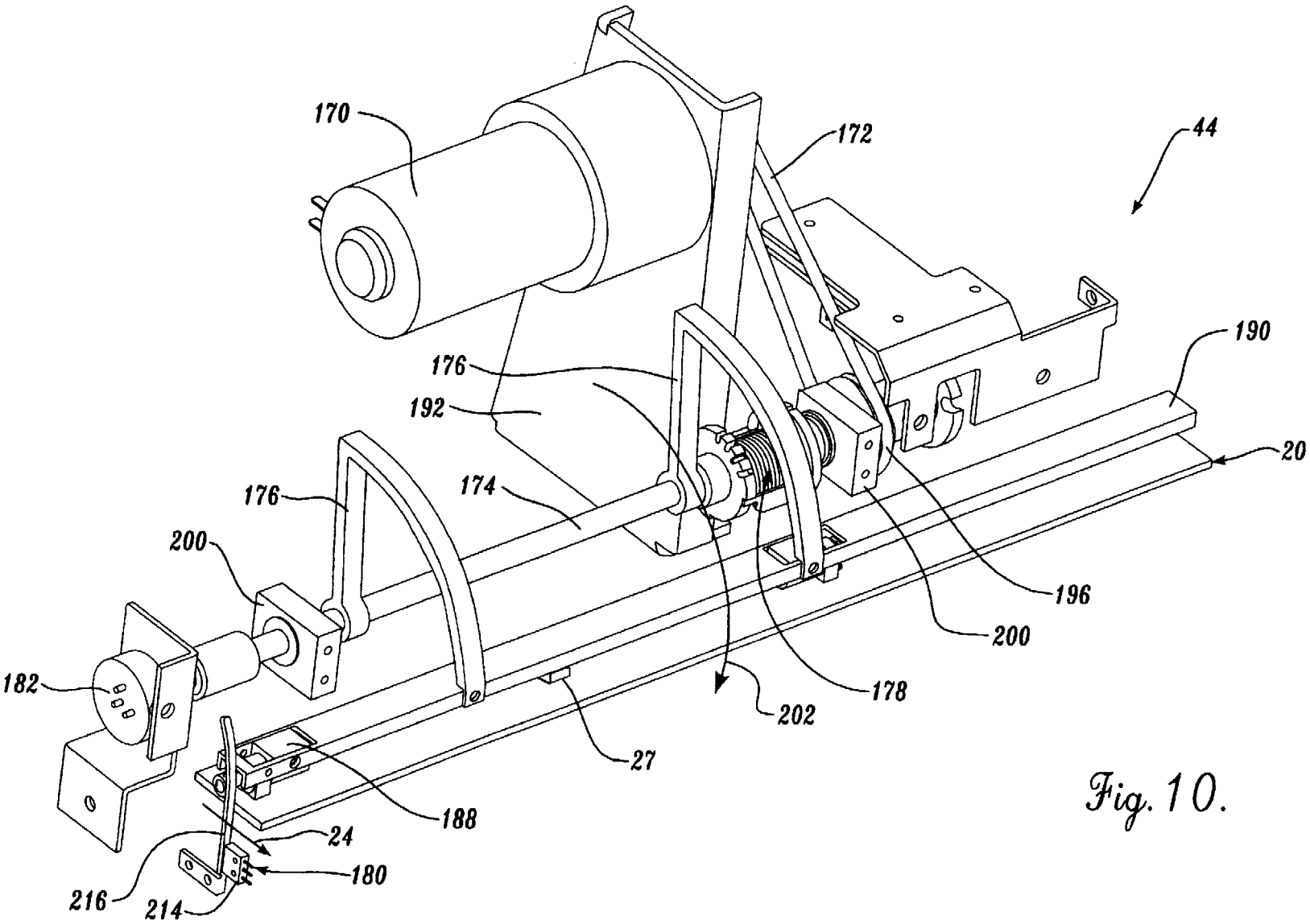
FIG. 10 is a perspective view of the paper hold down and sizing mechanism.
Figure 11:
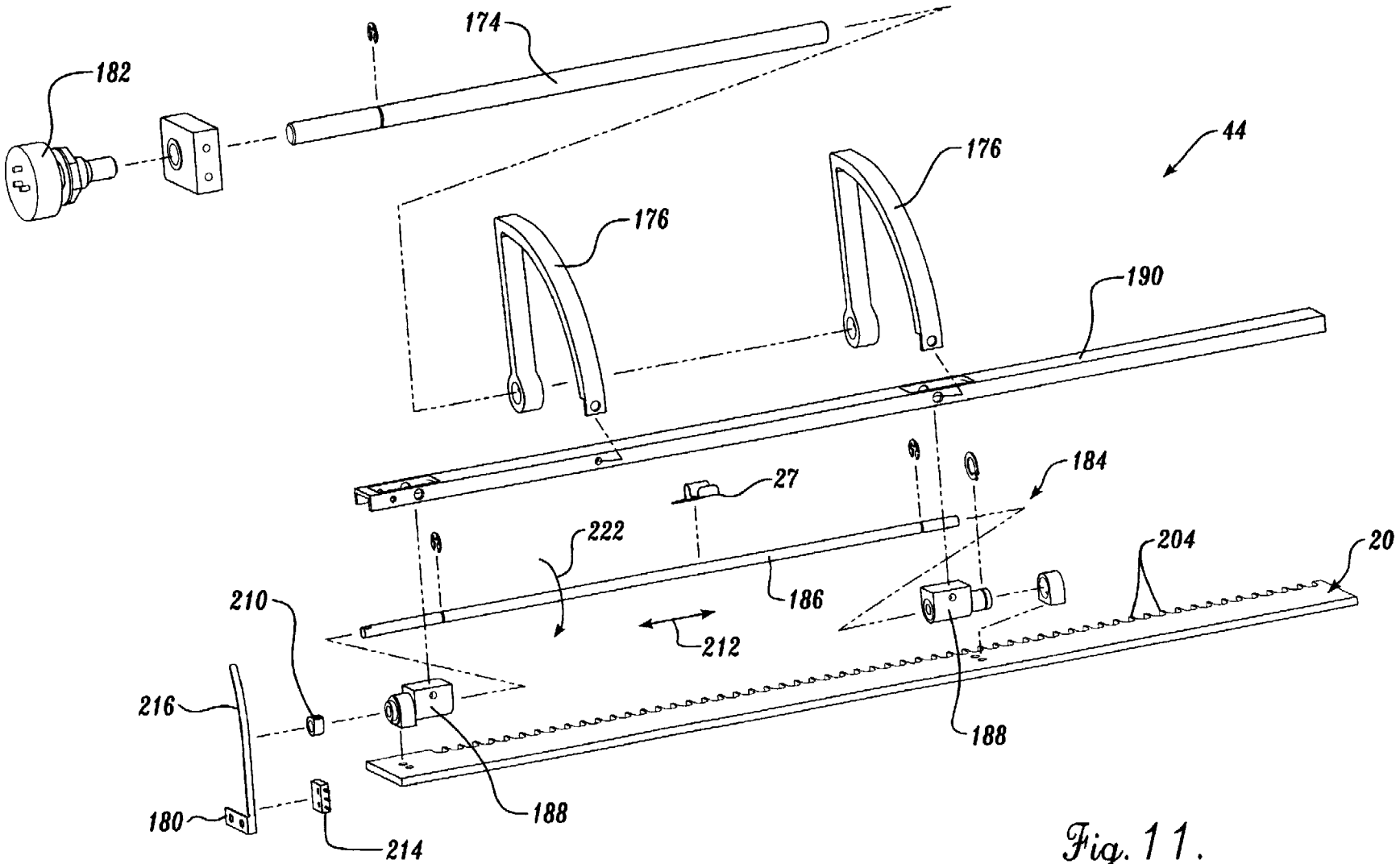
FIG. 11 is an exploded view of part of the paper hold down and sizing mechanism.

Clockwise rotation of the shalt 186 causes the lobed cam 210 to deform the deformable trigger 216 outward as illustrated by arrow 224 in FIG. 10. This outward movement of the deformable trigger 216 triggers the microswitch 214. Triggering the microswitch 214 in turn instructs the microprocessor that the binding operation is complete. The microprocessor then stops the coil feeder 32, triggers the coil cutter 36 and then raises the hold down bar 20 to its retracted position.

Figure 12:
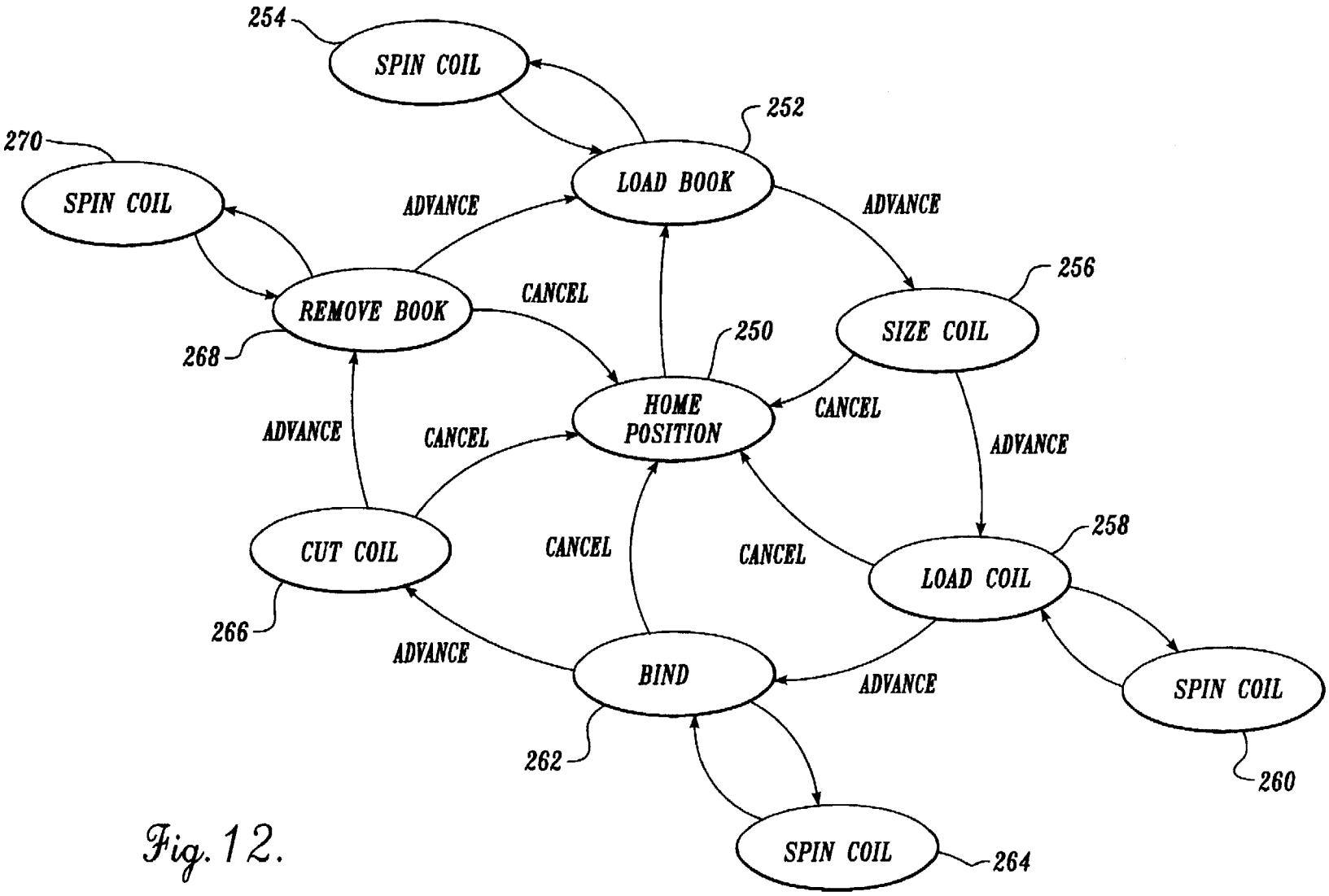
FIG. 12 is a state diagram illustrating the operation of the spiral binding apparatus of FIG. 1.

In order to fully understand the operation of the microprocessor and spiral binder 10, the state diagram of the preferred embodiment is illustrated in FIG. 12. After power up, the spiral binder 10 moves to its home position 250. In its home position, the hold down bar 20 is located in its retracted position and the locator pins 18 are in their extended position. The spiral binder 10 then provides the operator an indication that it is ready to load a stack of papers 12 or book for binding 252. If a short piece of coil 28 is located within the coil feeder 32 such that it triggers sensor 101 (FIG. 3) but not sensor 109 (FIG. 5), the coil feeder spins the coil 28 backwards out of the coil feeder as shown by state 254.

The operator then places the stack of papers 12 to be bound over the locator pins 18 upon the binding platform 14. The operator then presses the advance button 34, which causes the spiral binder 10 to size the coil required as shown by state 256. The spiral binder 10 sizes the coil by lowering the paper hold down bar 20. As discussed above, once the paper hold down bar 20 is lowered the sensor 182 provides the microprocessor an indication of the thickness of the stack of papers 12. This indication is used by the microprocessor to provide an indication of required coil size on the display 24.

After the coil is sized the operator loads the coil as shown in state 258 by inserting it through the aperture 30. The spiral binder then spins the coil into position 260. The advance button 34 is then depressed again and the spiral binder binds the stack of papers by spiraling the coils through the holes in the stack of papers as shown in states 262 and 264. Upon completion of the spiraling operation, the spiral binder stops the coil feeder 32. The advance button 34 is depressed again causing the coil 28 to be cut by the coil cutter 36 as illustrated in state 266. The bound book is then removed from the spiral binder as indicated in state 268. If the portion of the coil 28 remaining within the coil feeder 32 triggers the coil sensor 101 but not coil sensor 109, the remaining portion of the coil 28 is again spun out of the coil feeder 32 as shown in state 270. Once the advance button 34 is depressed again, the operation of the spiral binder 10 starts over and advances to the load book position 252. At any time during the binding operation, the operator may depress the cancel button 35, returning the spiral binder to the home position 250.

While the preferred embodiment of the invention has been illustrated and described, it will be appreciated that various changes can be made therein without departing from the spirit and scope of the invention. For example, the operation of the spiral binder could be automated upon insertion of the coil as opposed to depressing the advance button.

The embodiments of the invention in which an exclusive property or privilege is claimed are defined as follows:

1. An apparatus for spiral binding a stack of papers together as a unit, the apparatus comprising:

a coil feeder for rotatably feeding a preformed coil into a plurality of holes in the stack of papers, the coil feeder including:

a rotatably mounted roller;

a drive motor to rotate the roller;

a feed shaft spaced radially outward from the surface of the roller and positioned so that as the coil is fed into the coil feeder, onto the feed shaft, the coil contacts the roller and feed shaft and is rotated by the roller, wherein the roller applies a force on the coil to push the coil into contact with the feed shaft as the coil moves through the coil feeder; and a plurality of guides extending radially outward from the surface of the feed shaft, the guides being positioned on the feed shaft so that the coil spirals around the guides as the coil is fed through the coil feeder.

2. The apparatus of claim 1, wherein the guides extend radially outward from the surface of the feed shaft at approximately the same pitch as the loops of the coil.

3. The apparatus of claim 1, further comprising biasing means for biasing the roller toward the feed shaft.

4. The apparatus of claim 1, wherein one end of the roller is tapered.

5. The apparatus of claim 1, wherein the coil feeder includes a sensor to detect when the coil is inserted into the coil feeder and wherein the drive motor rotates the roller in response to an indication of the presence of a coil within the coil feeder.

6. The apparatus of claim 1, further including means for providing an operator an indication of the proper coil size to be used in binding the stack of papers.

7. The apparatus of claim 1, further including a hold down bar for pressing the stack of papers into contact with a binding platform during binding.

8. The apparatus of claim 7, wherein the paper hold down bar is part of a means for providing an operator an indication of the proper coil size to be used in binding the stack of papers.

9. The apparatus of claim 1, further comprises a coil cutter that cuts the coil to size after the coil feeder binds the stack of papers.

10. The apparatus of claim 9, further comprising a mechanism for detecting when the coil has spiraled through the holes in the stack of papers and for providing the coil cutter an indication of when to cut the coil to size.

11. The apparatus of claim 1, further comprising a plurality of locator pins that extend into the holes in the stack of papers to locate the stack of papers within the apparatus and that retract out of the holes in the stack of papers to allow the coil to be fed into the holes in the stack of papers.

12. The apparatus of claim 1, further comprising a mechanism for measuring the thickness of the stack of papers to be bound.

13. An apparatus for spiral binding a stack of papers together as a unit, the apparatus comprising:

a coil feeder for rotatably feeding a preformed spiral coil into a plurality of holes in the stack of papers;

a plurality of locator pins that are movable from an extended position in which the locator pins extend through the holes in the stack of papers and position the stack of papers in the proper position for binding and a retracted position in which the pins move out of the holes in the stack of papers to allow the coil to be fed into the holes in the stack of papers; and a hold down mechanism that holds the stack of papers in the proper position for binding while the coil feeder feeds the coil into the stack of papers.

14. The apparatus of claim 13, wherein the coil feeder further comprises:

a rotatably mounted roller;

a drive motor to rotate the roller; and a feed shaft spaced radially outward from the surface of the roller and positioned so that as the coil is fed into the coil feeder, onto the feed shaft, the coil contacts the roller and feed shaft and is rotated by the roller, and wherein the roller applies a force on the coil to push the coil into contact with the feed shalt as the coil moves through the coil feeder.

15. The apparatus of claim 14, wherein the coil feeder further comprises a plurality of guides extending radially outward from the surface of the feed shaft, the guides being positioned on the feed shaft so that the coil spirals around the guides as the coil is fed through the coil feeder.

16. The apparatus of claim 15, wherein the guides extend radially outward from the surface of the feed shaft at approximately the same pitch as the loops of the coil.

17. The apparatus of claim 14, wherein the end of the roller is tapered.

18. The apparatus of claim 1, wherein the coil feeder includes a sensor to detect when the coil is inserted into the coil feeder.

19. The apparatus of claim 13, further comprising a mechanism for providing an operator an indication of the proper coil size to be used in binding the stack of papers.

20. The apparatus of claim 13, further comprising a coil cutter that cuts the coil to size after the coil feeder binds the stack of papers.

21. A method of spiral binding a stack of papers, the method comprising the steps of:

placing a stack of papers within a spiral binding apparatus;

placing a coil between a feed shaft and a rotatably mounted roller so that the coil contacts and moves between the feed shaft and the roller;

applying a biasing force to the roller that biases the roller into contact with the coil which in turn biases the coil into contact with the feed shaft; and rotating the roller, causing the coil to rotate and spiral around a plurality of guides that extend radially outward from the surface of the feed shaft.

22. The method of claim 21, further comprising detecting when the coil is inserted between the feed shaft and the rotatable roller and rotating the coil in response to an indication of the presence of the coil.

23. The method of claim 21, further comprising positioning the stack of papers within the spiral binding apparatus upon a plurality of extendible and retractable locator pins that extend through holes in the stack of papers.

24. The method of claim 23, further comprising retracting the locator pins out of the holes in the stack of papers after the stack of papers is properly positioned to allow the coil to be spiraled through the holes in the stack of papers.

25. The method of claim 21, further comprising providing an operator an indication of the proper coil size to be used in binding the stack of papers by measuring the stack of papers after it has been placed within the spiral binding apparatus.

26. The method of claim 21, further comprising cutting the coil to size after the coil has been spiraled into the stack of papers.

* * * * *